US011834751B2

(12) United States Patent
Wei et al.

(10) Patent No.: US 11,834,751 B2
(45) Date of Patent: Dec. 5, 2023

(54) PREPARATION METHOD OF COPPER-BASED GRAPHENE COMPOSITE WITH HIGH THERMAL CONDUCTIVITY

(71) Applicant: CHANGZHOU UNIVERSITY, Changzhou (CN)

(72) Inventors: Wei Wei, Changzhou (CN); Feilong Jia, Changzhou (CN); Fuqiang Chu, Changzhou (CN); Kunxia Wei, Changzhou (CN); Qingbo Du, Changzhou (CN); Jing Hu, Changzhou (CN)

(73) Assignee: CHANGZHOU UNIVERSITY, Changzhou (CN)

( * ) Notice: Subject to any disclaimer, the term of this patent is extended or adjusted under 35 U.S.C. 154(b) by 203 days.

(21) Appl. No.: 17/437,056

(22) PCT Filed: Aug. 3, 2020

(86) PCT No.: PCT/CN2020/106517

§ 371 (c)(1),
(2) Date: Sep. 8, 2021

(87) PCT Pub. No.: WO2021/027606

PCT Pub. Date: Feb. 18, 2021

(65) Prior Publication Data

US 2022/0162764 A1 May 26, 2022

(30) Foreign Application Priority Data

Aug. 9, 2019 (CN) ..... 201910732825.5

(51) Int. Cl.
*C25D 1/00* (2006.01)
*C25D 17/00* (2006.01)
(Continued)

(52) U.S. Cl.
CPC ..... *C25D 1/00* (2013.01); *C25D 3/38* (2013.01); *C25D 5/34* (2013.01); *C25D 15/00* (2013.01); *C25D 17/007* (2013.01); *C25D 17/10* (2013.01)

(58) Field of Classification Search
None
See application file for complete search history.

(56) References Cited

U.S. PATENT DOCUMENTS

2014/0374267 A1* 12/2014 Monteiro ..... C25D 9/04 205/104

FOREIGN PATENT DOCUMENTS

CN 101665962 A 3/2010
CN 103943170 A 7/2014
(Continued)

OTHER PUBLICATIONS

Huang et al, Microelectronic Engineering, vol. 157, p. 7-12, 2016 (Year: 2016).*

(Continued)

*Primary Examiner* — Louis J Rufo
(74) *Attorney, Agent, or Firm* — Bayramoglu Law Offices LLC

(57) ABSTRACT

A preparation method of a copper-based graphene composite with high thermal conductivity is provided. A new electrodeposited solution is used for direct current (DC) electrodeposition at a reasonable electrodeposition frequency, which fabricates a new copper-based graphene composite with high tensile strength and thermal conductivity. The copper-based graphene composite prepared by electrodeposition has high thermal conductivity of 390-1112 W/(m·k) and tensile strength of 300-450 MPa, which meets the requirements in the field of thermal conduction.

6 Claims, 1 Drawing Sheet

(51) Int. Cl.

| | |
|---|---|
| ***C25D 17/10*** | (2006.01) |
| ***C25D 3/38*** | (2006.01) |
| ***C25D 5/34*** | (2006.01) |
| ***C25D 15/00*** | (2006.01) |

(56) References Cited

FOREIGN PATENT DOCUMENTS

| | | | | |
|---|---|---|---|---|
| CN | 103943226 | A | | 7/2014 |
| CN | 104060317 | A | | 9/2014 |
| CN | 104593841 | A | | 5/2015 |
| CN | 104846231 | A | * | 8/2015 |
| CN | 106350857 | A | | 1/2017 |
| CN | 109628983 | A | | 4/2019 |
| CN | 110408969 | A | | 11/2019 |
| IN | 103943281 | A | | 7/2014 |

OTHER PUBLICATIONS

Song et al , Gongsheng Song et al 2017 J. Electrochem. Soc. 164 D652) (Year: 2017).*

Kang, M.S. Kang et al., Thin Solid Films 516 (2008) 3761-3766 (Year: 2008).*

Huang, Microelectronic Engineering 157 (2016) 7-12 (Year: 2016).*

Wejrzanowski, Materials and Design 99 (2016) 163-173 (Year: 2016).*

Jiarong Chen, et al.., Preparation and Properties of Electrodeposited graphene-Cu/ Al Heat Conductive Material, 2015, pp. 1-70.

Kaifeng Zhang, et al., Forming Theory and Technology of Nano Materials, 2012.

Zhiliang Chen, Technical Guide for Electroplating Workshop, 2007.

Gang Huang, et al., Preparation and characterization of the graphene-Cu composite film by electrodeposition process, Microelectronic Engineering, 2016, pp. 7-12, 157.

* cited by examiner

PREPARATION METHOD OF COPPER-BASED GRAPHENE COMPOSITE WITH HIGH THERMAL CONDUCTIVITY

CROSS REFERENCE TO THE RELATED APPLICATIONS

This application is the national phase entry of International Application No. PCT/CN2020/106517, filed on Aug. 3, 2020, which is based upon and claims priority to Chinese Patent Application No. 201910732825.5, filed on Aug. 9, 2019, the entire contents of which are incorporated herein by reference.

TECHNICAL FIELD

The present disclosure belongs to the field of thermal conductive materials, and specifically relates to a preparation method of a copper-based graphene composite with high thermal conductivity.

BACKGROUND

With the development of science and technology, heat dissipation films have been applied on a large scale, which are closely related to our lives. Commonly-used items, including mobile phones and computers, for example, have built-in heat dissipation films. Traditional heat dissipation films are mainly made of copper, graphite, or the like. The heat dissipation film made of copper has excellent mechanical properties and electrical conductivity, but often exhibits poor heat dispersion, which caused a decreased work efficiency due to overheating after working for long periods. Graphite has excellent thermal conductivity, but shows poor mechanical and processing properties, which affects the practicability of graphite. Therefore, it is highly desirable to develop a material with excellent thermal and mechanical properties.

Graphene is a hexagonal honeycomb-shaped two-dimensional (2D) planar structure composed of a single layer of atoms (sp2-hybridized carbon atoms), which is a structural unit constituting graphite. Graphene has many excellent physical properties, such as ultra-high electron mobility as high as $2.5\times10^5$ $cm^2V^{-1}s^{-1}$. Young's modulus and thermal conductivity of single-layer graphene can reach 130 GPa and 5,000 W/(m·k), respectively.

Metal-based graphene composites can be prepared by various methods, mainly including powder metallurgy, hydrothermal synthesis, vapor deposition, electrodeposition, and so on. In the powder metallurgy method, a copper-based graphene material is prepared by low-temperature hot-pressing sintering, which involves many parameters, shows limitations on the shape of sintered bulk metal, and generally requires heat treatment for strengthening. The preparation of copper-based graphene by the hydrothermal process is controllable and leads to high crystal purity, but shows high requirements on equipment and large technical difficulty. In the vapor deposition method, copper-based graphene composite is fabricated by depositing a layer of graphene on the surface of substrate through temperature transformation, which is suitable for the production of thin-film materials and shows advantages such as simple process and uniform coating, while there are some problems, such as not dense coating and limited choices on substrate. In the electrodeposition method, copper-based graphene composite is prepared by oxidation-reduction method, and a specific solution is used as a medium, which has some advantages such as efficient process, uniform coating, and controllable size, while there are some disadvantages such as poor wettability between metal and graphene, large crystal grains, poor denseness of coating, and limited improvement of performance.

SUMMARY

The present disclosure is intended to develop an electrodeposition solution for a copper-based graphene composite that is reasonable in component ratio, environmentally friendly, low cost, and has a controllable thickness of coating. Copper-based graphene composite fabricated by the electrodeposition solution has excellent thermal conductivity and mechanical properties.

The present disclosure adopts the following technical solutions:

The present disclosure provides a preparation method of a copper-based graphene composite, specifically including the following steps:

(1) preparing an electrodeposition solution for the copper-based graphene composite, where the electrodeposition solution is composed of the following components in mass concentration: 90-200 g/L of copper sulfate pentahydrate, 2-20 mg/L of thiourea, 1-10 g/L of boric acid, 10-50 mg/L of polyethylene glycol (PEG) fatty acid ester, 0.05-3.5 g/L of graphene, and balance of deionized water; and (2) after anode (copper) and cathode (titanium or stainless steel) plates are activated, conducting electrodeposition on a substrate with the electrodeposition solution prepared in step (1) to obtain a coating of copper-based graphene composite, where the electrodeposition refers to direct current (DC) electrodeposition with high deposition efficiency, and the coating is uniform and dense.

A method for preparing the electrodeposition solution for the copper-based graphene composite in step (1) may include: subjecting a graphene solution to ultrasonic dispersion and dispersion in a high-speed homogenizer; mixing thiourea, boric acid, and PEG fatty acid ester into the graphene solution, accompanying with mechanical stirring; and mixing and dispersing a copper sulfate solution with the graphene solution by an electric mixer and a high-speed homogenizer to obtain the electrodeposition solution for the copper-based graphene composite. By such a preparation method, copper ions in the solution can play the role of isolating and separating graphene molecules, thus preventing the agglomeration and nonuniform dispersion of graphene and enabling more uniform distribution of components in the solution.

In the electrodeposition solution of the present disclosure, 2-20 mg/L of thiourea, 1-10 g/L of boric acid, and 10-50 mg/L of PEG fatty acid ester are additionally added. The effect of the additives: (1) increase the nucleation rate and refine crystal grains; (2) affect the growth and density change of crystal grains; and (3) improve the wettability between the substrate and the reinforcement, which could reduce a porosity.

In the step (2), the anode (copper) and cathode (titanium or stainless steel) plates are first activated as follows: washing the plates with an activation solution to remove oil, rust, and a surface oxide film, where the activation solution includes: 50 mL of sulfuric acid and 350 mL of deionized water.

The DC electrodeposition may be conducted under the following electrical parameters: 20-180 $mA/cm^2$ of current density and 300-1,000 Hz of DC frequency.

The DC electrodeposition may be conducted under the following environmental parameters: 0.5-5.0 h of electrodeposition time, 15-50° C. of electrodeposition solution temperature and 0.5 to 3 of electrodeposition solution pH.

During the process of electrodeposition, the quality of the coating is affected by many factors. The electrodeposition solution of the present disclosure can increase the cathode polarization and improve the wettability of the cathode, thereby affecting the binding force between copper and graphene and reducing the pores on the surface of the coating to improve the denseness. Moreover, the electrodeposition solution can increase the nucleation rate, refine the crystal grains, inhibit the abnormal growth of crystal grains, and improve the strength and smoothness of the coating. The copper sulfate-graphene electrodeposition solution used in the present disclosure is non-toxic, reasonable in component ratio, and recyclable, resulting in lower cost and environmental friendliness. By the electrodeposition solution, a bright copper-based graphene coating is prepared with uniform and compact structure.

The coating of the present disclosure may have a thickness designed to be 30-300 μm.

The prepared composite can reach a thermal conductivity as high as 390-1,112 W/(m·k) and a tensile strength as high as 300-450 MPa.

The present disclosure also provides an application of the copper-based graphene composite in the field of heat exchange of devices, which is used to improve the heat dissipation efficiency of a material, manufacture working heat dissipation coatings and heat dissipation wires for devices. For example, the composite can be used in CPU of precision electronics, heat sinks inside mobile phones, etc.

Beneficial effects of the present disclosure:

(1) Because of being low-cost and relatively simple, DC electrodeposition is adopted in the electrodeposition, which leads to obtain a bright, uniform and compact coating without rough and convex particles on the surface.

(2) The coating of the present disclosure has excellent thermal conductivity. Compared with pure copper, the material obtained in the present disclosure has similar electric conductivity, a tensile strength more than doubled, and a thermal conductivity more than doubled. The material can greatly improve the working efficiency and heat dissipation of equipment.

(3) The coating of the present disclosure can have a thermal conductivity as high as 1,112 W/(m·k) and a tensile strength as high as 450 MPa. The coating greatly improves the environmental applicability and practicability of the material.

DETAILED DESCRIPTION OF THE EMBODIMENTS

Figure 1:
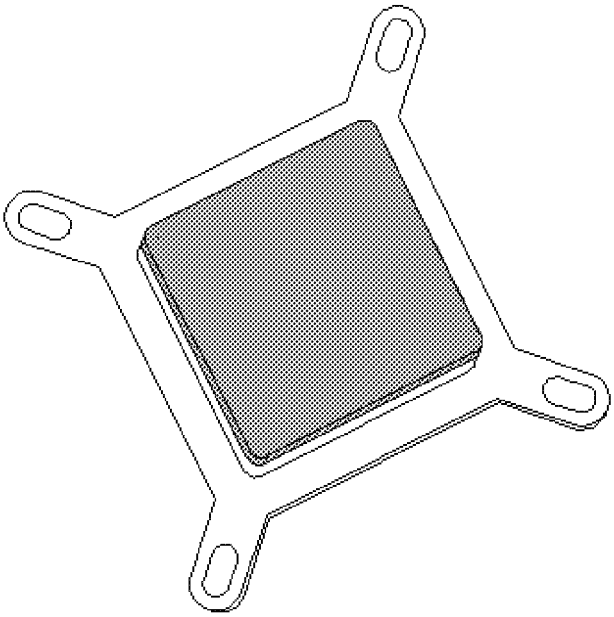
FIG. 1 shows an image of a heat dissipation coating made of the copper-based graphene composite prepared in the present disclosure.
Figure 2:
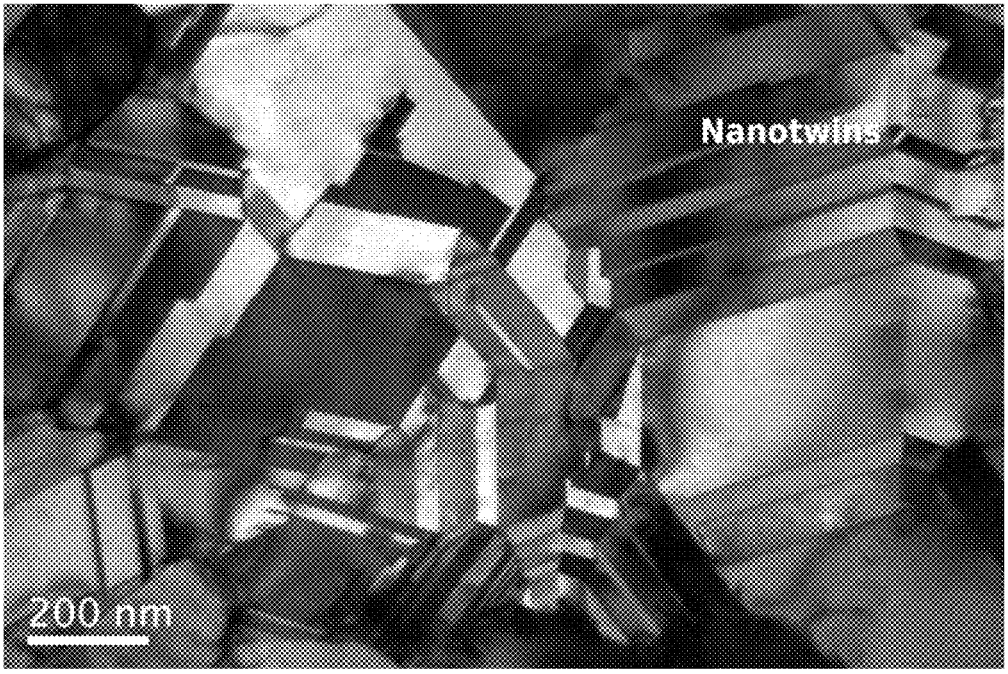
FIG. 2 shows a transmission electron microscopy (TEM) image of the copper-based graphene composite prepared in the present disclosure.

The present disclosure will be described in further detail below with reference to examples. In the following examples, the preparation of 1 L of an electrodeposition solution for the copper-based graphene composite is taken as an example.

Example 1

An electrodeposition solution for copper-based graphene was prepared according to the following component ratio: 200 g/L of copper sulfate pentahydrate, 0.05 g/L of graphene, 2 mg/L of thiourea, 2 g/L of boric acid, 10 mg/L of PEG fatty acid ester and the balance of deionized water. The anode and cathode plates were washed with an activation solution to remove oil, rust, and a surface oxide film, where the activation solution included: 50 mL of sulfuric acid and 350 mL of deionized water. The electrodeposition solution had a temperature of 20° C. and a pH of 0.5. DC electrodeposition was conducted under the following electrical parameters: 180 mA/cm$^2$ of current density, 300 Hz of electrodeposition frequency and 0.5 h of electrodeposition time. Under the above conditions, a coating with a uniform thickness of about 30 μm, had a bright surface and average denseness. The coating of the example can reach a thermal conductivity as high as 390 W/(m·k), and a tensile strength as high as 313±10 MPa.

The electrodeposition solution for the copper-based graphene composite was prepared as follows: a graphene solution with an alkyl surfactant was subjected to ultrasonic dispersion and then to dispersion in a high-speed homogenizer. Then thiourea, boric acid, and PEG fatty acid ester are mixed into the graphene, accompanying with mechanical stirring. Secondly, a copper sulfate solution is mixed and dispersed with the graphene solution by an electric mixer and a high-speed homogenizer to obtain the electrodeposition solution for the copper-based graphene composite.

Example 2

An electrodeposition solution for copper-based graphene was prepared according to the following component ratio: 200 g/L of copper sulfate pentahydrate, 1.0 g/L of graphene, 5 mg/L of thiourea, 4 g/L of boric acid, 20 mg/L of PEG fatty acid ester and the balance of deionized water. The anode and cathode plates were washed with an activation solution to remove oil, rust, and a surface oxide film, where the activation solution included: 50 mL of sulfuric acid and 350 mL of deionized water. The electrodeposition solution had a temperature of 30° C. and a pH of 1.0. DC electrodeposition was conducted under the following electrical parameters: 180 mA/cm$^2$ of current density, 500 Hz of electrodeposition frequency and 0.5 h of electrodeposition time. Under the above conditions, a coating with a uniform thickness of about 40 μm, had a bright surface and excellent denseness. The coating of the example can reach a thermal conductivity as high as 636 W/(m·k), and a tensile strength as high as 408±10 MPa.

The electrodeposition solution was prepared by the same method as in Example 1.

Example 3

An electrodeposition solution for copper-based graphene was prepared according to the following component ratio: 200 g/L of copper sulfate pentahydrate, 2 g/L of graphene, 10 mg/L of thiourea, 6 g/L of boric acid, 30 mg/L of PEG fatty acid ester and the balance of deionized water. The anode and cathode plates were washed with an activation solution to remove oil, rust, and a surface oxide film, where the activation solution included: 50 mL of sulfuric acid and 350 mL of deionized water. The electrodeposition solution had a temperature of 30° C. and a pH of 1.5. DC electrodeposition was conducted under the following electrical parameters: 180 mA/cm$^2$ of current density, 500 Hz of electrodeposition frequency and 1 h of electrodeposition time. Under the above conditions, a coating with a uniform thickness of about 80 μm, had a bright surface and excellent denseness. The coating of the example can reach a thermal conductivity as high as 1,112 W/(m·k), and a tensile strength as high as 450±10 MPa.

The electrodeposition solution was prepared by the same method as in Example 1.

Example 4

An electrodeposition solution for copper-based graphene was prepared according to the following component ratio: 200 g/L of copper sulfate pentahydrate, 2 g/L of graphene, 20 mg/L of thiourea, 10 g/L of boric acid, 40 mg/L of PEG fatty acid ester and the balance of deionized water. The anode and cathode plates were washed with an activation solution to remove oil, rust, and a surface oxide film, where the activation solution included: 50 mL of sulfuric acid and 350 mL of deionized water. The electrodeposition solution had a temperature of 30° C. and a pH of 2.0. DC electrodeposition was conducted under the following electrical parameters: 180 mA/cm$^2$ of current density, 800 Hz of electrodeposition frequency and 5 h of electrodeposition time. Under the above conditions, a coating with a uniform thickness of about 300 μm, had a small number of bulges on the surface and excellent denseness. The coating of the example can reach a thermal conductivity as high as 608 W/(m·k), and a tensile strength as high as 364±10 MPa.

The electrodeposition solution was prepared by the same method as in Example 1.

Example 5

An electrodeposition solution for copper-based graphene was prepared according to the following component ratio: 200 g/L of copper sulfate pentahydrate, 3.5 g/L of graphene, 20 mg/L of thiourea, 10 g/L of boric acid, 50 mg/L of PEG fatty acid ester and the balance of deionized water. The anode and cathode plates were washed with an activation solution to remove oil, rust, and a surface oxide film, where the activation solution included: 50 mL of sulfuric acid and 350 mL of deionized water. The electrodeposition solution had a temperature of 30° C. and a pH of 3. DC electrodeposition was conducted under the following electrical parameters: 180 mA/cm$^2$ of current density, 1,000 Hz of electrodeposition frequency and 5 h of electrodeposition time. Under the above conditions, a coating with a uniform thickness of about 300 μm, had a large number of bulges on the surface and excellent denseness. The coating of the example can reach a thermal conductivity as high as 544 W/(m·k), and a tensile strength as high as 323±10 MPa.

The electrodeposition solution was prepared by the same method as in Example 1.

Comparative Example 1

An electrodeposition solution for copper-based graphene was prepared according to the following component ratio: 200 g/L of copper sulfate pentahydrate, 2 g/L of graphene and the balance of deionized water. The anode and cathode plates were washed with an activation solution to remove oil, rust, and a surface oxide film, where the activation solution included: 50 mL of sulfuric acid and 350 mL of deionized water. The electrodeposition solution had a temperature of 30° C. and a pH of 1.5. DC electrodeposition was conducted under the following electrical parameters: 180 mA/cm$^2$ of current density, 500 Hz of electrodeposition frequency and 1 h of electrodeposition time. Under the above conditions, a coating with a uniform thickness of about 75 μm, had an average denseness and a smooth surface without pores. The coating of the example can reach a thermal conductivity as high as 584 W/(m·k), and a tensile strength as high as 276±10 MPa.

Comparative Example 2

An electrodeposition solution for copper-based graphene was prepared according to the following component ratio: 200 g/L of copper sulfate pentahydrate, 2 g/L of graphene, 10 mg/L of thiourea, 30 mg/L of PEG fatty acid ester and the balance of deionized water. The anode and cathode plates were washed with an activation solution to remove oil, rust, and a surface oxide film, where the activation solution included: 50 mL of sulfuric acid and 350 mL of deionized water. The electrodeposition solution had a temperature of 30° C. and a pH of 1.5. DC electrodeposition was conducted under the following electrical parameters: 180 mA/cm$^2$ of current density, 500 Hz of electrodeposition frequency and 1 h of electrodeposition time. Under the above conditions, a coating with a uniform thickness of about 80 μm, had an average denseness and a bright surface with some bulges. The coating of the example can reach a thermal conductivity as high as 568 W/(m·k), and a tensile strength as high as 342±10 MPa.

Comparative Example 3

An electrodeposition solution for copper-based graphene was prepared according to the following component ratio: 200 g/L of copper sulfate pentahydrate, 2 g/L of graphene, 10 mg/L of thiourea, 6 g/L of boric acid, 30 mg/L of PEG fatty acid ester and the balance of deionized water. The thiourea, boric acid, and PEG fatty acid ester were subjected to dispersion with a graphene dispersion in a high-speed homogenizer, and then a resulting mixture was mixed with a copper sulfate solution. The anode and cathode plates were washed with an activation solution to remove oil, rust, and a surface oxide film, where the activation solution included: 50 mL of sulfuric acid and 350 mL of deionized water. The electrodeposition solution had a temperature of 30° C. and a pH of 1.5. DC electrodeposition was conducted under the following electrical parameters: 180 mA/cm$^2$ of current density, 500 Hz of electrodeposition frequency and 1 h of electrodeposition time. Under the above conditions, a coating with a uniform thickness of about 260 μm, had an average denseness, a large number of bulges and a small number of pores on the surface. The coating of the example can reach a thermal conductivity as high as 696 W/(m·k), and a tensile strength as high as 324±10 MPa.

The above examples are preferred implementations of the present disclosure, but the present disclosure is not limited to the above implementations. Any obvious improvement, substitution, or modification made by those skilled in the art without departing from the essence of the present disclosure should fall within the protection scope of the present disclosure.

What is claimed is:

1. A preparation method of a copper-based graphene composite with a high thermal conductivity, comprising the following steps;

(1) preparing an electrodeposition solution for the copper-based graphene composite, wherein the electrodeposition solution comprises additives of thiourea and boric acid;

(2) an activation of anode and cathode plates; washing the anode and cathode plates with an activation solution to remove oil, rust, and a surface oxide film, wherein the activation solution comprises: 50 mL of sulfuric acid and 350 mL of deionized water; and (3) conducting an electrodeposition with the electrodeposition solution prepared in step (1) to obtain the copper-based graphene composite, wherein the electrodeposition refers to a direct current (DC) electrodeposition, and the copper-based graphene composite has a thermal conductivity of 390-1,112 W/(m·k).

2. The preparation method of the copper-based graphene composite according to claim 1, wherein the electrodeposition solution for the copper-based graphene composite in step (1) is composed of the following components in mass concentration: 90-200 g/L of copper sulfate pentahydrate, 2-20 mg/L of thiourea, 1-10 g/L of boric acid, 10-50 mg/L of polyethylene glycol (PEG) fatty acid ester, 0.05-2.0 g/L of graphene and a balance of deionized water.

3. The preparation method of the copper-based graphene composite according to claim 1, wherein a method for preparing the electrodeposition solution in step (1) comprises:

subjecting a graphene solution to an ultrasonic dispersion and a dispersion in a high-speed homogenizer;

mixing thiourea, boric acid, and PEG fatty acid ester into the graphene solution, accompanying with mechanical stirring; and mixing and dispersing a copper sulfate solution with the graphene solution by an electric mixer and the high-speed homogenizer to obtain the electrodeposition solution for the copper-based graphene composite.

4. The preparation method of the copper-based graphene composite according to claim 1, wherein the DC electrodeposition in step (3) is conducted under the following electrical parameters: 20-180 mA/cm$^2$ of a current density and 300-1,000 Hz of a DC frequency; and the DC electrodeposition is conducted under the following environmental parameters: 0.5-5.0 h of an electrodeposition time, 15-50° C. of an electrodeposition solution temperature and 0.5-3 of an electrodeposition solution pH.

5. The preparation method of the copper-based graphene composite according to claim 1, wherein a coating obtained in step (3) has a thickness of 30 μm to 300 μm.

6. A method of using the copper-based graphene composite prepared by the preparation method according to claim 1, comprising: using the copper-based graphene composite in a field of thermal conduction.

* * * * *